US005455403A

United States Patent [19]

Kim et al.

[11] Patent Number: 5,455,403

[45] Date of Patent: Oct. 3, 1995

[54] DEVICE FOR CONTROLLING MICROWAVE POWER OF A MICROWAVE OVEN

[75] Inventors: Byeongjun Kim; Wookeum Jun, both of Incheon; Wonpyo Hong, Kyungki-do; Sangjin Kim, Incheon; Byungkap Lim, Seoul; Heungdae Kang, Incheon; Jaewon Cho, Seoul, all of Rep. of Korea

[73] Assignee: Daewoo Electronics Co., Ltd., Seoul, Rep. of Korea

[21] Appl. No.: 366,717

[22] Filed: Dec. 30, 1994

[30] Foreign Application Priority Data

Aug. 17, 1994 [KR] Rep. of Korea ..... 94-20733

[51] Int. Cl.[6] ..... H05B 6/68

[52] U.S. Cl. ..... 219/702; 219/719; 219/715; 200/38 FA

[58] Field of Search ..... 219/719, 720, 219/722, 715, 702; 200/38 FA, 38 R

[56] References Cited

U.S. PATENT DOCUMENTS

| | | | |
|---|---|---|---|
| 4,079,636 | 3/1978 | Altenschute et al. | 200/38 FA |
| 4,697,057 | 9/1987 | Fowler | 219/719 |
| 4,835,349 | 5/1989 | Weber | 200/38 FA |
| 5,097,105 | 3/1992 | Boin et al. | 219/702 |
| 5,134,262 | 7/1992 | Lee | 219/703 |

*Primary Examiner*—Philip H. Leung

*Attorney, Agent, or Firm*—Lowe, Price, LeBlanc & Becker

[57] ABSTRACT

Disclosed is a microwave power controlling device having a reduced production cost and an improved assembling work efficiency by using a simple structure and the reduced number of components. A supporting stepped portion is formed on an inner surface portion of a control panel having a rotating through hole formed at a central portion thereof into which a knob axis for controlling the microwave power is inserted. An elastic piece and a pair of stoppers are formed on an upper surface of the supporting stepped portion. On an opposite surface of the supporting stepped portion, a microwave power controlling gear is mounted. The microwave power controlling gear has an engaging jaw for defining a rotating range thereof and a ring-shaped guide portion having plural notched grooves engaged with the elastic piece. The microwave power controlling gear is meshed with a coupling gear meshed with a microwave power controlling circuit gear of a timer body. The engaging jaw and stoppers define a rotation range of the microwave power controlling gear. Thus, the microwave power controlling device is simple to improve the production thereof and the assembling work efficiency.

3 Claims, 4 Drawing Sheets

DEVICE FOR CONTROLLING MICROWAVE POWER OF A MICROWAVE OVEN

BACKGROUND OF THE INVENTION

1. Field of the Invention

The present invention relates to a device for controlling microwave power of a microwave oven and more particularly, to a device for controlling microwave power of the microwave oven having a simple structure.

2. Description of the Prior Arts

In general, an electric field room of a microwave oven is provided with a magnetron for generating microwave. First and second induction coils of a high voltage transformer are disposed on a bottom plate of the electric field room. A high voltage which is generated by a mutually induced operation of these coils is applied to the magnetron thereby to generate the microwave. Such microwave is irradiated toward an inside of a cooking chamber of the microwave oven through an irradiating tube, by which the food inside the cooking chamber is heated to be cooked.

Cooking time and the strength (i.e., the power) of microwave supplied thereto are controlled by adjusting a cooking mode suitable for cooking various foods which are inside the cooking chamber in accordance with the kind of the foods. Therefore, the microwave oven is provided with a timer for controlling the cooking time and a device for controlling the microwave power.

A control panel which controls an overall operation of the microwave oven is disposed on a portion of the front panel of the microwave oven. The timer and the controlling device are disposed on the control panel.

Meanwhile, in a conventional microwave oven the timer and the microwave power controlling device are disposed on the control panel using a separate bracket. FIG. 4 is a perspective view for showing the conventional microwave oven having the control panel. In the figure, reference numeral 100 indicates a microwave oven, 105 indicates a control panel, 110 indicates a knob for controlling the microwave power and 120 indicates a timer knob. FIG. 5 is a perspective view for showing a device for controlling the microwave power which is coupled to microwave power controlling knob 110 of the microwave oven as shown in FIG. 4. FIG. 6 is a schematic sectional view for showing an engaged state of a timer with the microwave power controlling device of FIG. 5. As shown in these figures, in a conventional microwave oven a knob hole 116 for fixing the microwave power controlling device and a knob hole 117 for fixing the timer knob structure are formed at a back plate 111. A knob shaft 118 coupled to a knob 110 of the microwave power controlling device is inserted into knob hole 116 of the microwave power controlling device, and a timer knob shaft 121 coupled to timer knob 120 is inserted into timer knob hole 117. Knob 110 of the microwave power controlling device and timer knob 120 are attached to control panel 105 to be exposed outside, so that a user can manually modulate them.

A microwave power controlling cam 113 is connected and secured to knob shaft 118 through microwave power controlling knob hole 116 of back plate 111. A circular gear portion is formed at a lower portion of cam 113 which is fixed by bracket 150. A plate spring 114 is provided between an inner surface of bracket 150 and cam 113 to rotatably support cam 113. The gear portion of cam 113 is connected to timer 125 through a connection rack 112. Connection rack 112 has a "d" shape and a first rack portion 112A which is formed on an inner surface of a closed curved line and a second rack portion 112B which is formed on an extension of the enclosed curved line. First rack portion 112A is meshed with the gear portion of cam 113, and second rack gear portion 112B is meshed with a microwave power controlling circuit gear 126 of timer 125. Timer 125 is provided with a time circuit and a microwave power controlling circuit for controlling the microwave power of the microwave oven. The microwave power is controlled by changing the position of microwave power controlling circuit gear 126.

When microwave power controlling knob 110 is manually rotated in view of the user's necessity, the rotating force of microwave power controlling knob 110 is transmitted to cam 113 which drives connection rack 112 through the connection gear portion to straightly move connection rack 112. The driving force of connection rack 112 is transmitted to microwave power controlling circuit gear 126 of timer 125 having the microwave power controlling circuit to locate microwave power controlling circuit gear 126 at a predetermined position, so that the desired microwave power may be obtained.

The microwave power controlling device attached to the conventional microwave oven has numerous components such as bracket 150, plate spring 114, cam 113 and connection rack 112, and also includes back plate 111 for fixing the microwave power controlling device and timer 125. Due to the numerous components, the production cost increases and many steps for assembling them are necessary. Further, there are some difficulties in manufacturing the microwave power controlling device due to the complicated structure of the connection rack.

SUMMARY OF THE INVENTION

The present invention is intended to overcome the above-mentioned and numerous other disadvantages and deficiencies of the prior art. Therefore, it is an object of the present invention to provide a microwave power controlling device of a microwave oven which can reduce the production cost and improve the work efficiency by using a simple construction and the reduced number of components.

To achieve the above-described object of the present invention, the microwave power controlling device of a microwave oven includes:

- a supporting stepped portion formed on an inner surface portion of a control panel, the supporting stepped portion having a rotating through hole formed on a central portion there into which a knob axis for controlling the microwave power is inserted;
- an elastic piece formed on an upper surface of the supporting stepped portion;
- a microwave power controlling gear having an engaging jaw for defining a rotation range thereof and a ring-shaped guide portion having plural notched grooves engaged with the elastic piece, the microwave power controlling gear being mounted on the supporting stepped portion;
- a pair of stoppers for defining the rotating range of the microwave power controlling gear to be engaged with the engaging jaw; and
- a coupler gear meshed with a microwave power controlling gear and a microwave power controlling circuit gear of a timer body.

The supporting stepped portion preferably has a disc shape. The engaging jaw and the stoppers have the same radius of gyration centering around the knob axis.

A rotation of the microwave power controlling knob causes the supply modulation gear to be rotated. At this time, the elastic piece formed on the supporting stepped portion which is in contact with the surface of guide portion formed on the opposite surface of the microwave power controlling gear is engaged with the notched portions formed on the guide portion with a predetermined distance. Meanwhile, when the microwave power controlling gear is positively or reversely rotated, a rotation range of the microwave power controlling gear is defined with engagement with the stopper. The microwave power in the microwave oven can be controlled within a predetermined range by coupling the microwave power controlling gear to the microwave power controlling circuit gear of a timer body.

BRIEF DESCRIPTION OF THE DRAWINGS

The present invention may be better understood and its numerous objects and advantages will be more apparent to those skilled in the art by reference to the accompanying drawings in which.

DESCRIPTION OF THE PREFERRED EMBODIMENT

The preferred embodiments of the present invention will be described in detail with reference to the accompanying drawings.

Figure 1:
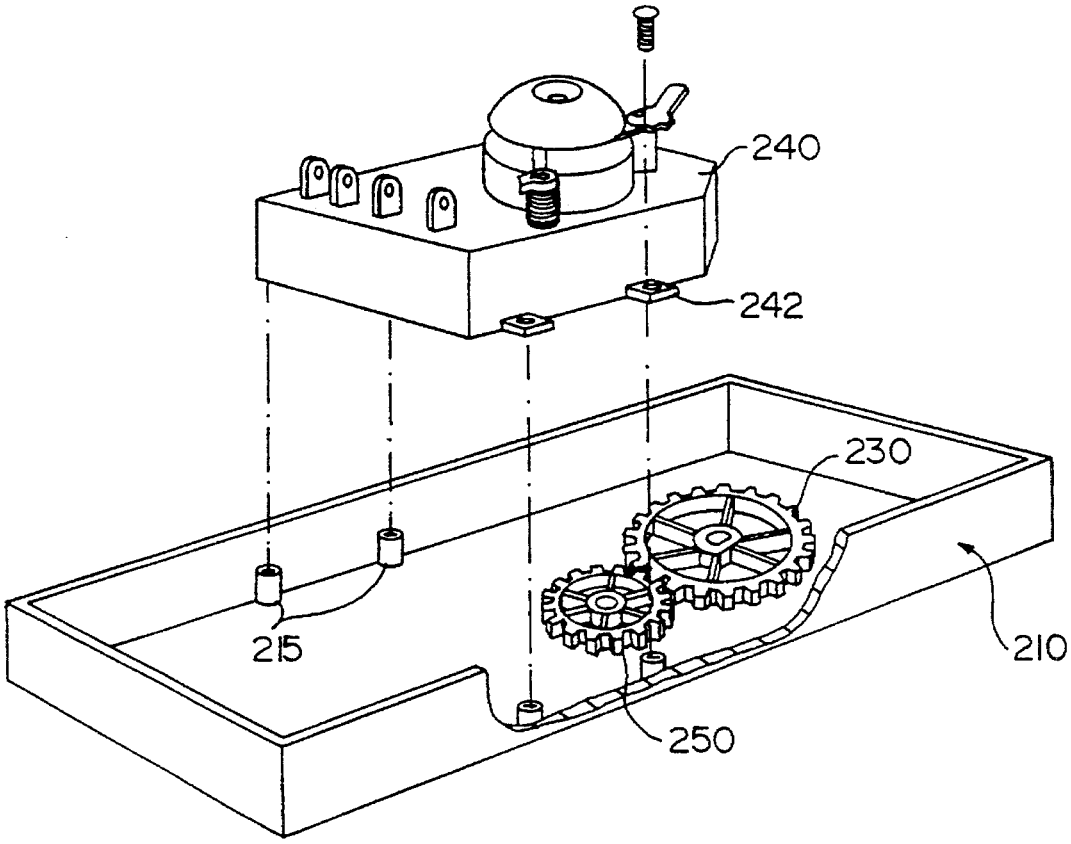
FIG. 1 is a view for showing a separated state of a timer and a control panel to which a microwave power controlling device is attached according to one embodiment of the present invention.
Figure 2:
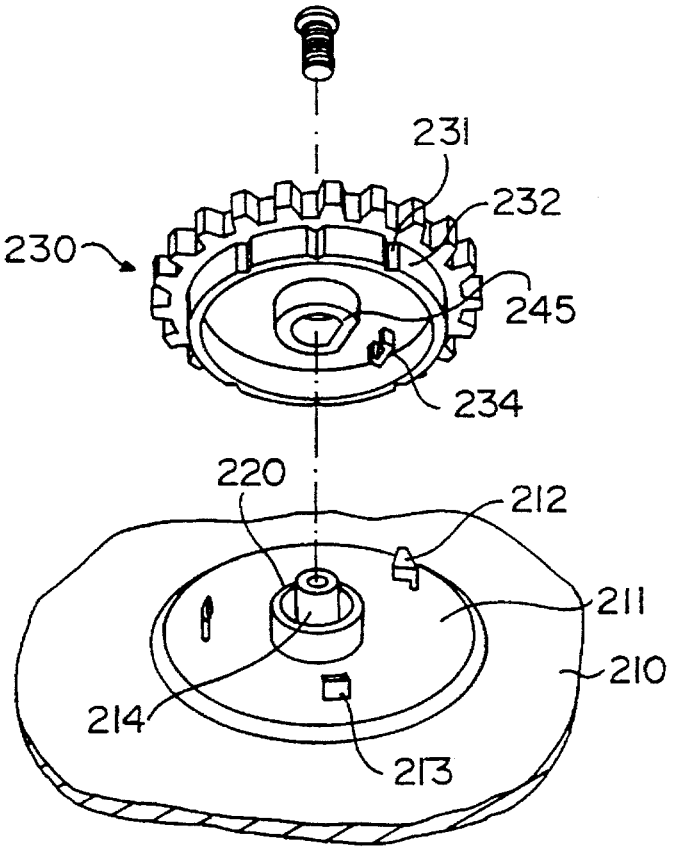
FIG. 2 is a view for showing a separated state of the microwave power controlling device from the control panel as shown in FIG. 1.

FIG. 1 is a view for showing a separated state of a timer and a control panel to which a microwave power controlling device is attached according to one embodiment of the present invention. FIG. 2 is a view for showing a separated state of the microwave power controlling device from the control panel as shown in FIG. 1.

Figure 6:
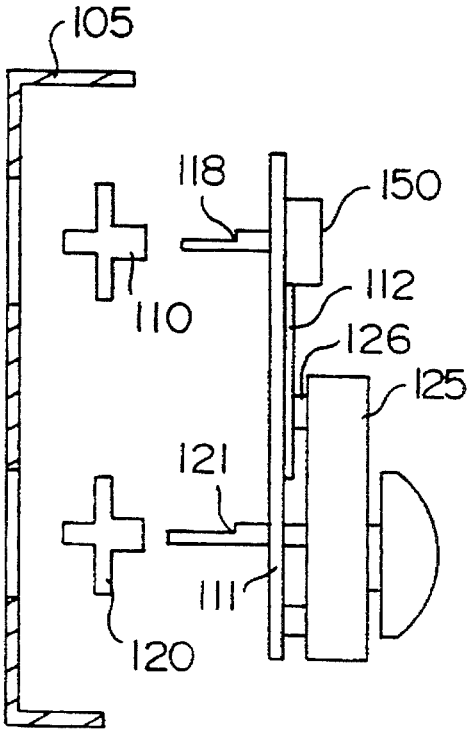
FIG. 6 PRIOR ART
FIG. 6 is a schematic sectional view for showing an engaged state of a timer with the microwave power controlling device of FIG. 5.
Figure 5:
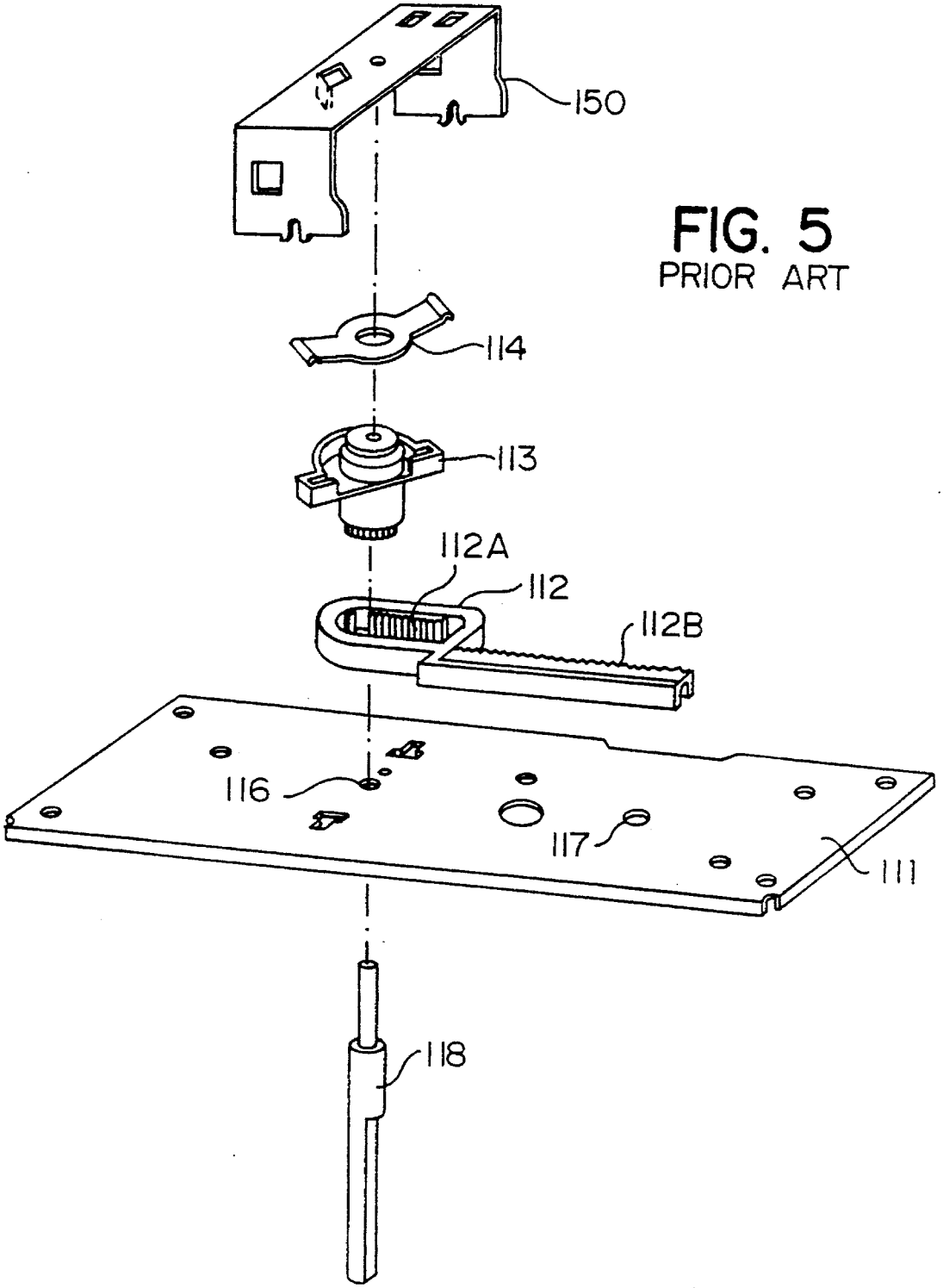
FIG. 5 PRIOR ART
FIG. 5 is a perspective view for showing a device for controlling the microwave power which is coupled to the microwave power controlling knob of the microwave oven as shown in FIG. 4.

On a central inner portion of a control panel 210, a disc-shaped supporting stepped portion 211 is protrudingly formed. At a central portion of supporting stepped portion 211 there is formed a rotating through hole 214 for receiving a knob axis 220 for controlling the microwave power into which a cylinder is inserted. As shown in FIG. 6, knob axis 220 has a shape which can be inserted into an insertion groove of a conventional microwave power controlling knob 110.

Microwave power controlling gear 230 which can be rotated with knob axis 220 inserted thereinto is mounted on supporting stepped portion 211. On an opposite surface of microwave power controlling gear 230 directed to supporting stepped portion 211 there is formed a ring-shaped guide portion 231 having plural notched grooves which are appropriate for controlling the microwave power of the microwave oven. On a central portion of microwave power controlling gear 230 there is provided a knob axis cylinder 245 which has a shape appropriate for receiving knob axis 220. Microwave power controlling gear 230 is secured to knob axis 220 by a screw. An engaging jaw 234 for defining a rotation range of microwave power controlling gear 230 is formed on the opposite surface of microwave power controlling gear 230 between ring-shaped guide portion 231 and knob axis cylinder 245.

Meanwhile, an elastic piece 212 which can be engaged with a notched groove 232 of guide portion 231 of microwave power controlling gear 230 is formed on supporting stepped portion 211. Further, a pair of stoppers by which engaging jaw 234 of microwave power controlling gear 230 is necked are formed on supporting stepped portion 211. When microwave power controlling gear 230 is rotated, engaging jaw 234 is necked by stoppers 213 to define the rotation angle range of microwave power controlling gear 230.

A timer body 240 for controlling the irradiating time of the microwave oven has plural fixing pieces 242 formed on a lower end of both sides thereof. Fixing pieces 242 of timer body 240 are secured to bosses 215 of control panel 210 formed on a position corresponding to fixing piece 242 by the screws thereby to fix timer body to control panel 210.

The microwave power controlling device of the microwave oven according to the present embodiment has a coupling gear 250 which is meshed with a microwave power controlling gear 230 for transmitting a rotating force of microwave power controlling gear 230 to a microwave power controlling circuit gear (not shown) connected to the microwave power controlling circuit within timer body 240.

Figure 4:
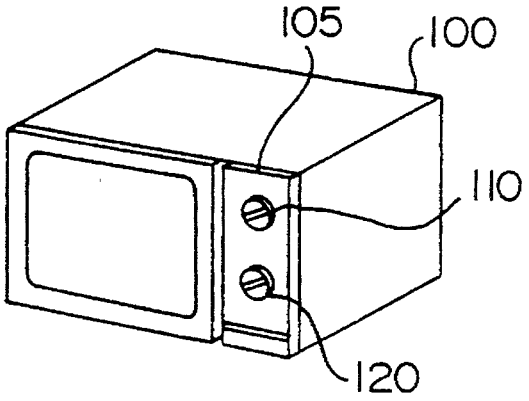
FIG. 4 PRIOR ART
FIG. 4 is a perspective view for showing the conventional microwave oven having the control panel.

An appearance of the microwave oven wherein the microwave power controlling device of the present invention is attached to control panel 210 is the same as that shown in FIG. 4.

When the microwave power controlling knob on control panel 210 (not shown but same as indicated by reference numeral 110 of FIG. 4) is rotated, microwave power controlling gear 230 is rotated together therewith. Coupler gear 250 meshed with microwave power controlling gear 230 transmits the rotation force to the microwave power controlling circuit gear of timer body 240, thereby to control the power of the microwave in the microwave oven. Elastic piece 212 of supporting stepped portion 211 is engaged with notched groove 232 of guide portion 231 formed on the opposite surface of microwave power controlling gear 230 at a predetermined distance. Engaging jaw 234 formed on microwave power controlling gear 230 is necked by stopper 213 of supporting stepped portion 211 to thereby define the microwave power within a predetermined range.

More particularly, supporting stepped portion 211 is projected from the inner surface of control panel 210 into which the microwave power controlling knob is inserted. Rotation through hole 214 is formed at the central portion of supporting stepped portion 211. Microwave power controlling knob axis 220 is inserted into rotating through hole 214 from the outside and microwave power controlling gear 230 is provided thereto from the inside to receive microwave power controlling knob axis so that microwave power controlling knob axis 220 and microwave power controlling gear 230 are coupled together. Knob axis 220 and microwave power controlling gear 230 are coupled by a coupling device such as screw and the like to improve the coupling force.

Engaging jaw 234 is formed on the opposite surface of microwave power controlling gear 230. A pair of stoppers 213 are formed on an upper surface of supporting stepped portion 211, and stoppers 213 have a radius (from the center of supporting stepped portion 211) corresponding to the radius (from the center of microwave power controlling gear 230) of engaging jaw 234. Therefore, when microwave power controlling gear 230 is positively or reversely rotated, engaging jaw 234 is necked by stoppers 213, so that microwave power controlling gear 230 is rotated within the predetermined angle range defined by stoppers 213. Thus, by using the above angle rage, microwave power controlling gear 230 is appropriately connected to the microwave power controlling circuit gear within timer body 250 in order to control appropriately the microwave power.

An operation of the microwave power controlling device according to the present invention will be described in the following.

Figure 3:
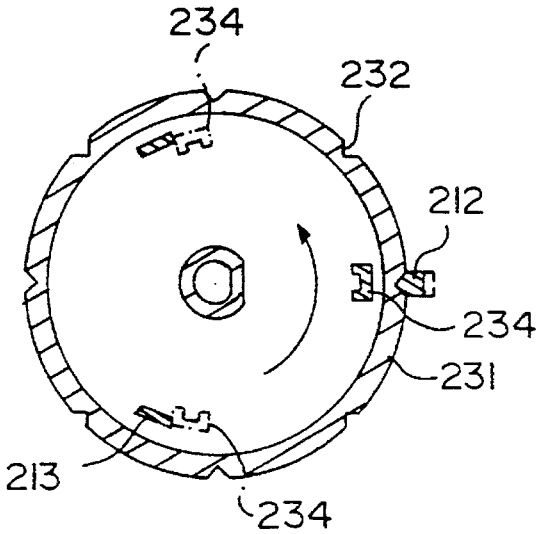
FIG. 3 is a schematic view for showing operations between the guide groove and an elastic piece, and between the engaging jaw and the stopper when rotating the microwave power controlling gear of FIGS. 1 and 2.

FIG. 3 is a schematic view for showing operations between the guide groove and an elastic piece, and between the engaging jaw and the stopper when rotating the microwave power controlling gear of FIGS. 1 and 2.

As shown in the figure, when controlling the microwave power a rotation of microwave power controlling knob causes microwave power controlling gear 230 to rotate. At this time, elastic piece 212 formed on supporting stepped portion 211 which is in contact with the surface of guide portion 231 formed on the opposite surface of microwave power controlling gear 230 is engaged with notched portions 232 formed on guide portion 231 with a predetermined distance. Meanwhile, when microwave power controlling gear 230 is rotated in a positive direction (right direction) or in a reverse direction (left direction), engaging jaw 234 formed thereon is necked by stopper 213 formed on the surface of supporting stepped portion 211 so that it may not rotate any more. The microwave power of the microwave oven can be controlled within a predetermined range by connecting microwave power controlling gear 230 to the circuit gear of the microwave power controlling circuit of timer body 240 within the predetermined angle range where microwave power controlling gear 230 can be rotated.

Ring-shaped guide portion 231 is formed on the opposite surface of microwave power controlling gear 230. Elastic piece 212 is formed on the upper surface of stepped portion 211 with an elastic force. Elastic piece 212 is in contact with guide portion 231 to be engaged with notched groove 232 by the elastic force, when microwave power controlling gear 230 is rotated.

Plural fixing pieces 242 are formed on the lower end of both sides of timer body 240. Bosses 215 are provided on the given positions of the inner periphery of control panel 210 corresponding to the positions of fixing piece 242. After aligning fixing pieces 242 with bosses 215, timer body 242 can be simply coupled to control panel 210 by using the coupling device such as screw and the like.

In the microwave power controlling device of the microwave oven according to the present invention, the microwave power controlling device having microwave power controlling gear 230, coupler gear 250 and timer body 240 is directly installed without any additional bracket. Further, the timer can be directly disposed on the control panel.

The microwave power controlling device of the microwave oven according to the present invention is provided with the microwave power controlling gear and the coupling gear. The microwave power in the microwave oven can be controlled using the same, so that its structure is simple in size. Further, the microwave power controlling gear, the coupler gear and the timer body can disposed thereon to reduce the components as necessary and improve the assembling work efficiency therefor.

It is understood that various other modifications will be apparent to and can be readily made by those skilled in the art without departing from the scope and spirit of this invention. Accordingly, it is not intended that the scope of the claims appended thereto be limited to the description as set forth herein, but rather that the claims be constructed as encompassing all the features of the patentable novelty that reside in the present invention, including all the features that would be treated as equivalents thereof by those skilled in the art to which this pertains.

What is claimed is:

1. A device for controlling a microwave power in a microwave oven comprising:

a supporting stepped portion formed on an inner surface portion of a control panel, said supporting stepped portion having a rotating through hole formed on a central portion thereof into which a knob axis for controlling the microwave power is inserted;

an elastic piece formed on an upper surface of said supporting stepped portion;

a microwave power controlling gear having an engaging jaw for defining a rotation range thereof and a ring-shaped guide portion having plural notched grooves engaged with said elastic piece, said microwave power controlling gear being mounted on said supporting stepped portion;

a pair of stoppers for defining the rotating range of said microwave power controlling gear to be engaged with said engaging jaw; and a coupler gear meshed with said microwave power controlling gear and a microwave power controlling circuit gear of a timer body.

2. The device for controlling a microwave power as claimed in claim 1, wherein said supporting stepped portion has a disc shape.

3. The device for controlling a microwave power as claimed in claim 1, wherein said engaging jaw and said stoppers have the same rotation radius centering around said knob axis.

* * * * *